US010822212B1

(12) United States Patent
Dodge, IV et al.

(10) Patent No.: US 10,822,212 B1
(45) Date of Patent: Nov. 3, 2020

(54) COUNTERWEIGHT ATTACHMENT MECHANISM FOR A CRANE

(71) Applicant: Altec Industries, Inc., Birmingham, AL (US)

(72) Inventors: William Baldwin Dodge, IV, Roanoke, VA (US); Johnson X. Miles, Roanoke, VA (US)

(73) Assignee: Altec Industries, Inc., Birmingham, AL (US)

( * ) Notice: Subject to any disclaimer, the term of this patent is extended or adjusted under 35 U.S.C. 154(b) by 0 days.

(21) Appl. No.: 16/898,734

(22) Filed: Jun. 11, 2020

(51) Int. Cl.
*B66C 23/78* (2006.01)
*B66C 13/04* (2006.01)
*B66C 23/76* (2006.01)

(52) U.S. Cl.
CPC ..... *B66C 23/78* (2013.01); *B66C 13/04* (2013.01); *B66C 23/76* (2013.01)

(58) Field of Classification Search
CPC ..... B66C 23/72; B66C 23/74; B66C 23/76; B66C 23/78; B66C 13/04; B66C 13/00; E02F 9/18; B62D 49/085
See application file for complete search history.

(56) References Cited

U.S. PATENT DOCUMENTS 3,375,021 A * 3/1968 Grider ..... B66C 23/74 280/759
3,625,558 A 12/1971 Johnson
4,402,413 A * 9/1983 Sickler ..... E02F 9/18 212/178
5,179,794 A 1/1993 Ballinger
5,199,583 A * 4/1993 Weider ..... B66C 23/74 212/178
5,524,777 A * 6/1996 Weber ..... B66C 23/74 212/178
2006/0043042 A1* 3/2006 Kimura ..... B66C 23/74 212/178
2006/0103125 A1* 5/2006 Yamamoto ..... B62D 49/085 280/760
2007/0090074 A1* 4/2007 Willim ..... B66C 23/74 212/178
2011/0031728 A1* 2/2011 Arzberger ..... E02F 9/085 280/755
2012/0160795 A1* 6/2012 Liu ..... B66C 23/74 212/178
2015/0246795 A1* 9/2015 Copeland ..... B66C 23/76 414/719
2016/0185576 A1* 6/2016 Bitz ..... B66C 23/76 212/197

(Continued)

*Primary Examiner* — Michael R Mansen
*Assistant Examiner* — Juan J Campos, Jr.
(74) *Attorney, Agent, or Firm* — Erise IP, P.A.

(57) ABSTRACT

A system and method for connecting a removable counterweight system to a crane including a lower assembly adapted to be connected to the counterweight system, an upper assembly adapted to be mounted to the crane, and a latch block assembly mounted to the upper assembly. The latch block assembly includes a plurality of blocks cooperating together to form a central counterbore for receiving a stud therein. The blocks are mounted within the upper assembly by at least one axle to allow for rotation of the blocks. A distal end of the stud is removably connected to the latch block assembly to attach the counterweight system to the crane.

20 Claims, 12 Drawing Sheets

(56) References Cited

U.S. PATENT DOCUMENTS

| | | | | |
|---|---|---|---|---|
| 2018/0022586 | A1* | 1/2018 | Koenig | B66C 23/76 212/197 |
| 2018/0044150 | A1* | 2/2018 | Mori | B66C 23/74 |
| 2018/0057323 | A1* | 3/2018 | Mebus | B66C 23/74 |
| 2018/0229981 | A1* | 8/2018 | Yamamoto | B66C 23/54 |
| 2018/0273354 | A1* | 9/2018 | Yamamoto | B66C 23/68 |
| 2019/0169001 | A1* | 6/2019 | Boos | B66C 13/12 |

* cited by examiner

COUNTERWEIGHT ATTACHMENT MECHANISM FOR A CRANE

BACKGROUND

1. Field

Embodiments of the invention relate to crane operation. More specifically, embodiments of the invention relate to an installation system for removable counterweights on cranes.

2. Related Art

Cranes, digger derricks, and other heavy equipment utilize a boom assembly, a load line, and a winch to lift heavy loads. The winch is typically disposed on a base, and the load line runs from the winch along the boom assembly to an implement at the distal end of the boom. The implement then routes the load line downward so as to allow a load to be attached thereto. The winch may then be operated to reduce the available length of the load line and therefore lift the load.

On the other end of the boom to balance the load and prevent the crane from tipping over, a counterweight is commonly provided. A counterweight may be permanent or removable. On a crane with a removable counterweight, it is desirable the counterweight is installed properly to prevent injury or machine damage.

There are two main types of removable counterweight systems: pinned slab systems and tray systems. In a known pinned slab system, multiple slabs are first stacked and pinned together to form a unitary counterweight. Then, the cylinders are aligned with the lifting eyes on the top slab. The cylinders are then lowered, the pins are inserted, and the pinned slab can be raised. The cylinders are thereby used to pull the top slab up to the crane turntable. However, it is difficult for an operator to view and line up the cylinders with the lifting eyes and to install the pins. Furthermore, because the counterweight hangs on the cylinder, additional stow pins are often required to eliminate drift.

In a known tray counterweight system, multiple slabs are stacked on a tray and the cylinders pull up on the tray to install the counterweight. Known methods used to attach the cylinders to the tray counterweight system are a keyhole interface or a swing-through interface. FIG. 2 shows an example of the keyhole interface, as is known in the prior art. The keyhole interface method requires the operator to slew the turntable to a specific location, lower or raise the cylinders through the stack of slabs, slew the turntable to another specific location, and then pull the stack of slabs up. In a keyhole interface system, there is a swing-thru slot that can be entered from either side. The counterweight system hangs from a cylinder and either a secondary catch or pressure accumulators keep the counterweight from drifting down. However, nothing keeps the tray from sliding off of the cylinders until the cylinders are fully raised, thus presenting a potential safety hazard.

What is needed is a simpler and safer process for installing a counterweight system on a crane. The counterweight attachment mechanism of the invention reduces operator error and lowers the chances of inadvertent machine damage from running the machine into itself during the counterweight installation process.

The invention describes an improved system for attaching either a pinned slab counterweight system or a tray counterweight system to a crane structure.

SUMMARY

Embodiments of the invention solve the above-mentioned problems by providing a system and method for easily and safely mounting a counterweight system to a crane.

A first embodiment of the invention is directed to an attachment mechanism for connecting a removable counterweight system to a crane. The attachment mechanism comprises a lower assembly adapted to be connected to the counterweight system, an upper assembly adapted to be mounted to the crane, and a latch block assembly mounted to the upper assembly. The lower assembly comprises a stud. The upper assembly comprises a frame formed by an inner plate and an outer plate attached together having a gap therebetween. The latch block assembly comprises a plurality of blocks cooperating together to form a central counterbore for receiving the stud therein. The plurality of blocks are mounted within the frame by at least one axle extending through a bore of at least one block of the plurality of blocks to allow for rotation of the at least one block. A distal end of the stud is removably connected to the latch block assembly to attach the counterweight system to the crane.

A second embodiment of the invention is directed to a system for connecting a removable counterweight system to a crane. The system comprises a crane comprising a boom assembly having a proximal end and a distal end, a turntable attached to the proximal end of the boom assembly, and an attachment mechanism for connecting the removable counterweight system to the turntable. The attachment mechanism comprises a lower assembly adapted to be connected to the counterweight system, an upper assembly mounted to the turntable, and a latch block assembly mounted to the upper assembly. The lower assembly comprises a stud. The upper assembly comprises a frame formed by an inner plate and an outer plate attached together having a gap therebetween. The latch block assembly comprises a plurality of blocks cooperating together to form a central counterbore for receiving the stud therein. The plurality of blocks are mounted within the frame by at least one axle extending through a bore of at least one block of the plurality of blocks to allow for rotation of the at least one block. A distal end of the stud is removably connected to the latch block assembly to attach the counterweight system to the crane.

A third embodiment of the invention is directed to a method of connecting a removable counterweight system to a crane with an attachment mechanism. The attachment mechanism comprises a lower assembly adapted to be connected to the counterweight system, an upper assembly adapted to be mounted to the crane, and a latch block assembly mounted to the upper assembly. The lower assembly comprises a plate assembly including a cylinder, and a stud having a shaft mounted within the cylinder and a head extending from a distal end of the cylinder. The upper assembly comprises a frame formed by an inner plate and an outer plate attached together having a gap therebetween. The latch block assembly comprises a plurality of blocks cooperating together to form a central counterbore for receiving the stud therein. The plurality of blocks are mounted within the frame by at least one axle extending through a bore of at least one block of the plurality of blocks to allow for rotation of the at least one block. The method comprises raising the lower assembly such that the head of the stud pushes up on at least one block of the plurality of blocks to cause the at least one block to rotate from a closed position to an open position, and then lowering the lower assembly such that the head of the stud rests in the central counterbore thereby attaching the counterweight system to the crane.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 8A:
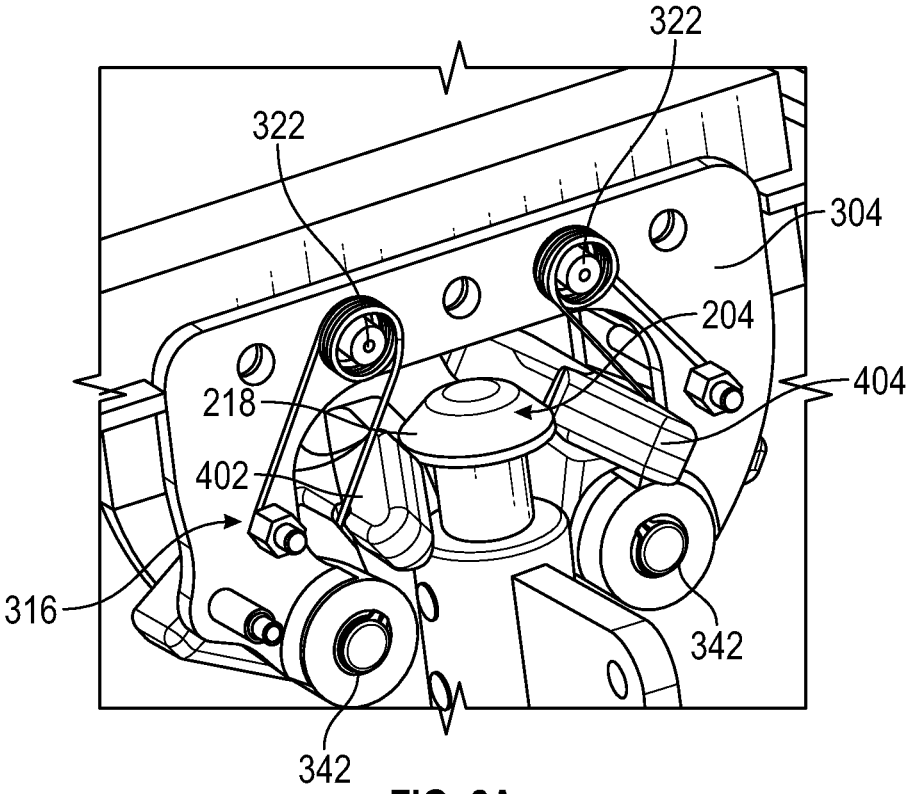
Figure 8B:
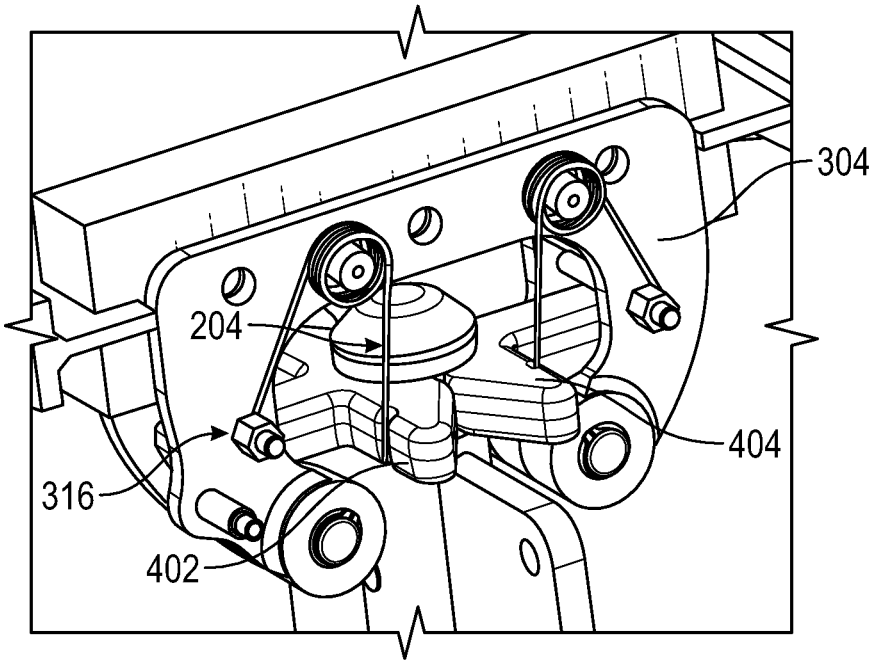
Figure 8C:
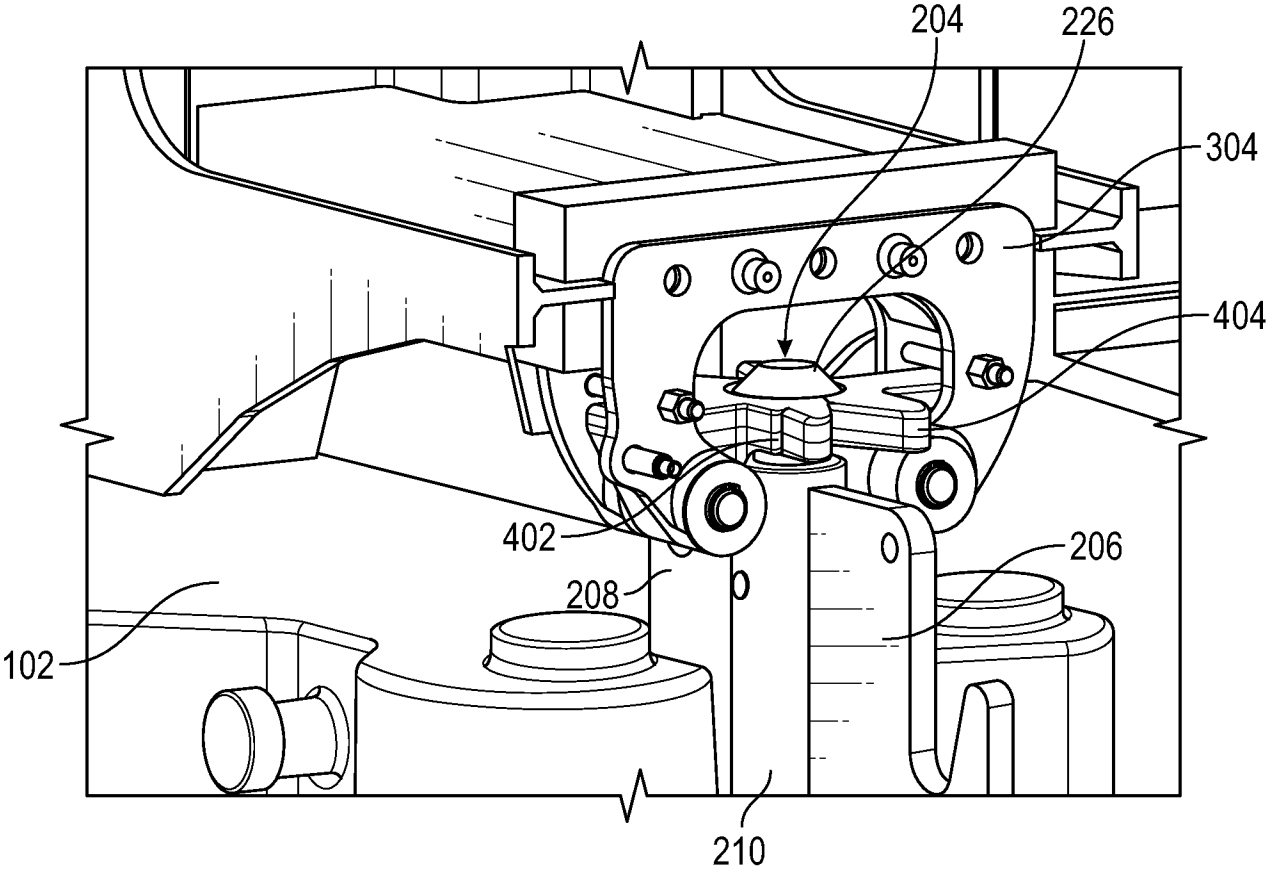
Figure 9:
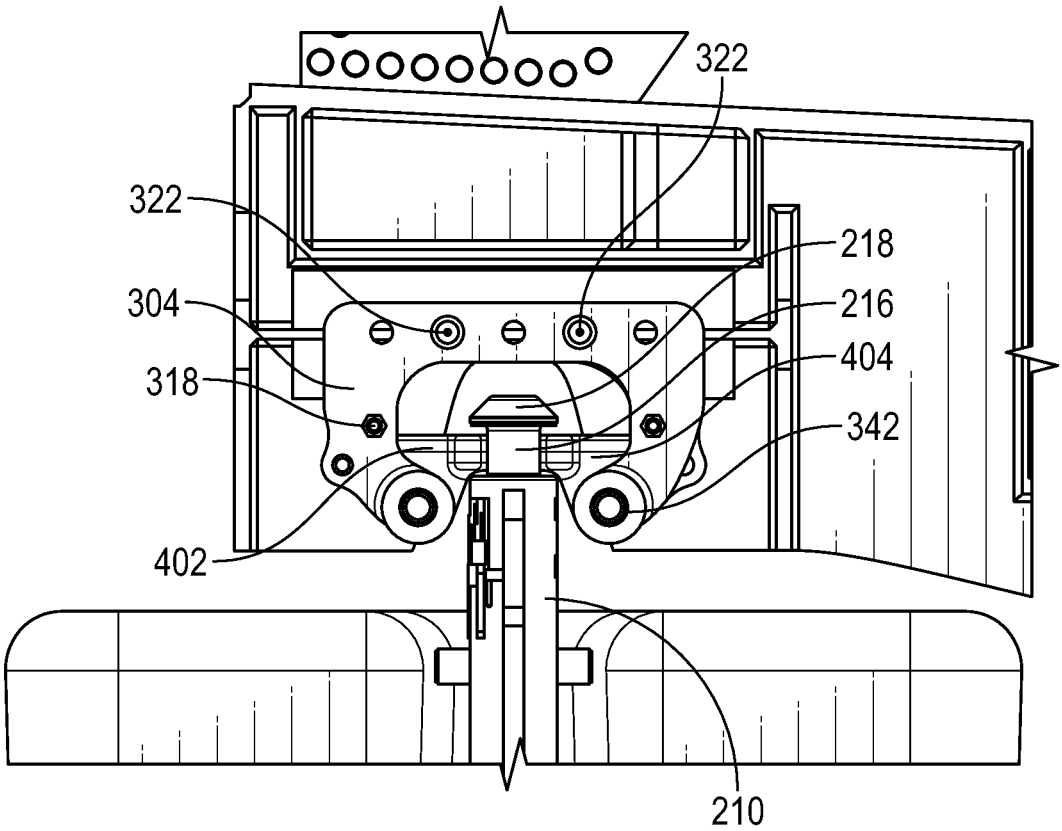

FIGS. 8A, 8B, and 8C are perspective views showing the operation of the attachment mechanism according to an embodiment of the invention; and FIG. 9 is a cross-sectional view of the attachment mechanism according to an embodiment of the invention.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the technology can include a variety of combinations and/or integrations of the embodiments described herein.

Figure 1:
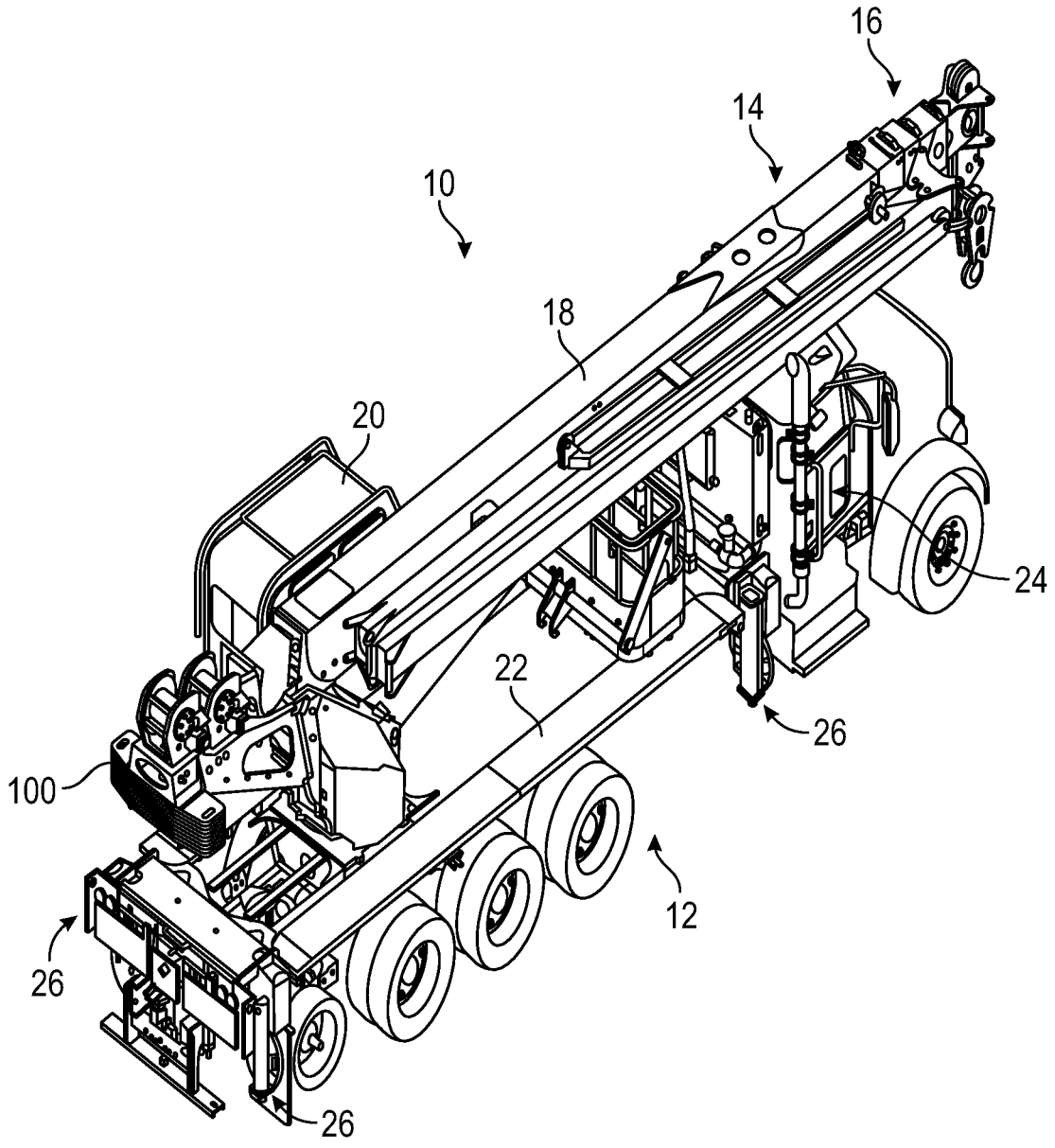
FIG. 1 is a perspective view of a crane assembly including a counterweight system in a stowed position.
Figure 2:
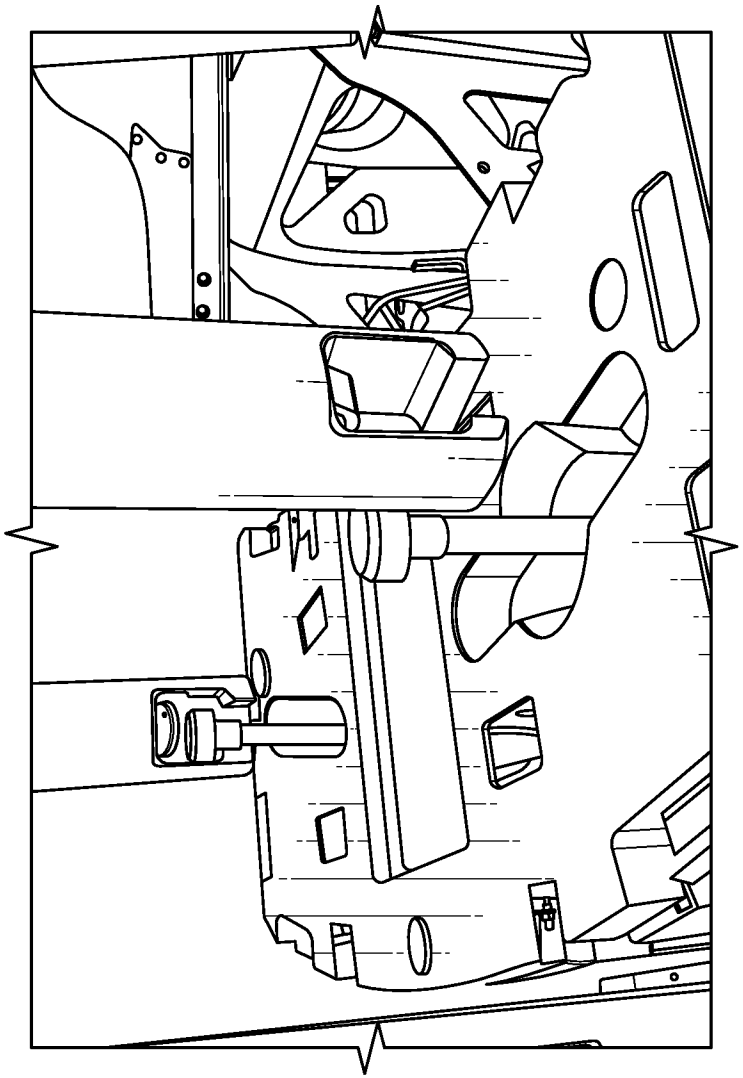
FIG. 2 (Prior Art)
FIG. 2 is a perspective view of an attachment mechanism for a counterweight system according to the prior art.

FIG. 1 illustrates a crane 10 comprising a base 12 having a boom assembly 14 rotatably mounted thereto. The boom assembly 14 may include at least one inner boom section 16 that can telescope out of an outer boom section 18. A static-operations cab 20 may be disposed on a first side of the boom assembly 14. The base 12 may also include a deck 22 upon which an operator can stand. Further, the base 12 can include a mobile-operations cab 24, which the operator uses to drive the crane 10 between worksites.

The base 12 of the crane is a selectively stabilized platform. In some embodiments, the base 12 may be a crane chassis, a utility truck, an aerial device, an oil rig, an earth-working machine, or a fixed structure. The base 12 provides stability and a counterweight to a load being supported by the boom assembly 14, including a counterweight system 100. Larger loads typically require a more stable and a heavier base 12. To achieve this stability, in some embodiments of the invention, the base 12 may utilize a set of outriggers 26 or other hydraulic stabilizers.

Figure 3A:
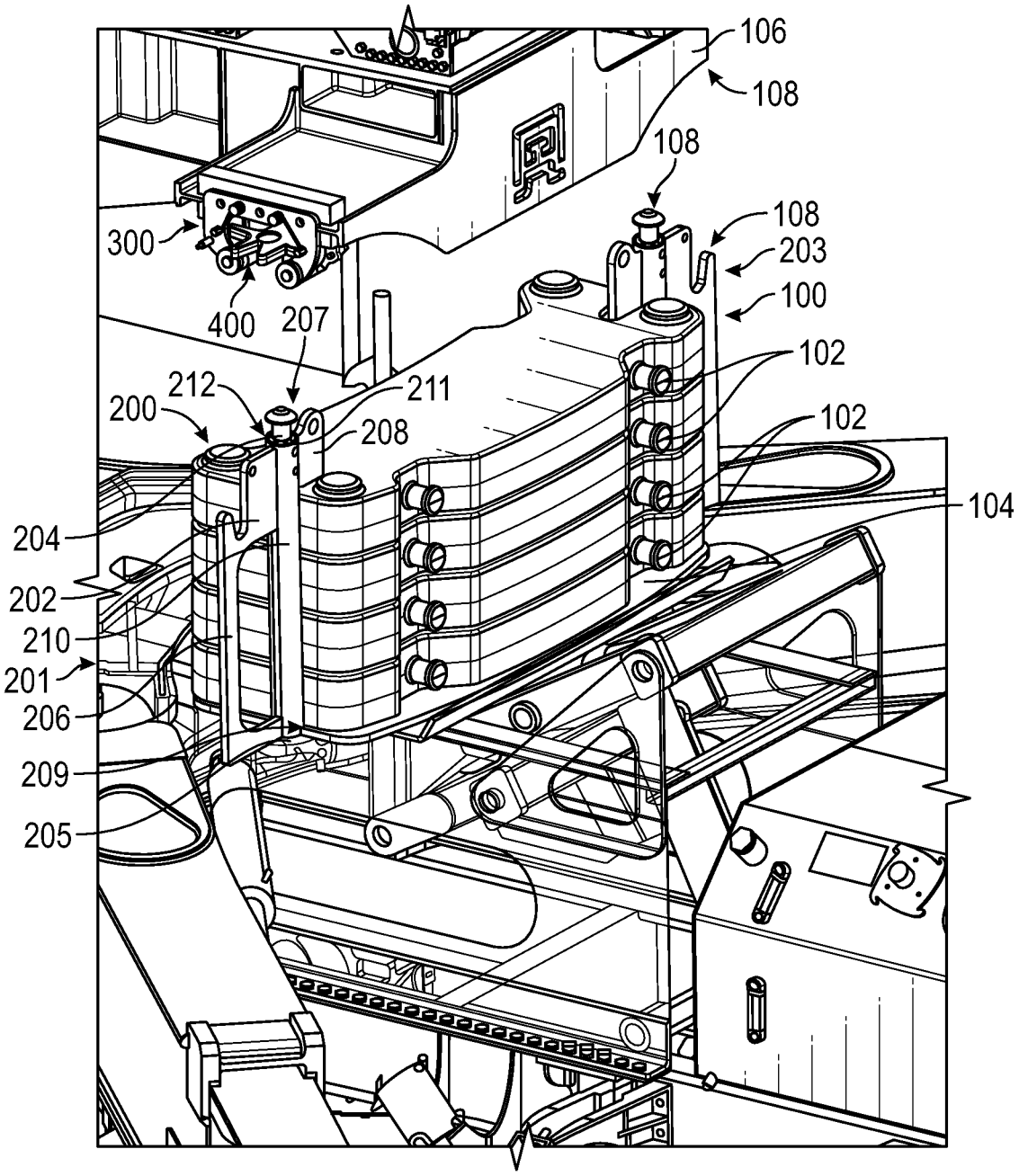
FIG. 3A is a perspective view of a removable counterweight system and attachment mechanism according to an embodiment of the invention in a detached position.
Figure 3B:
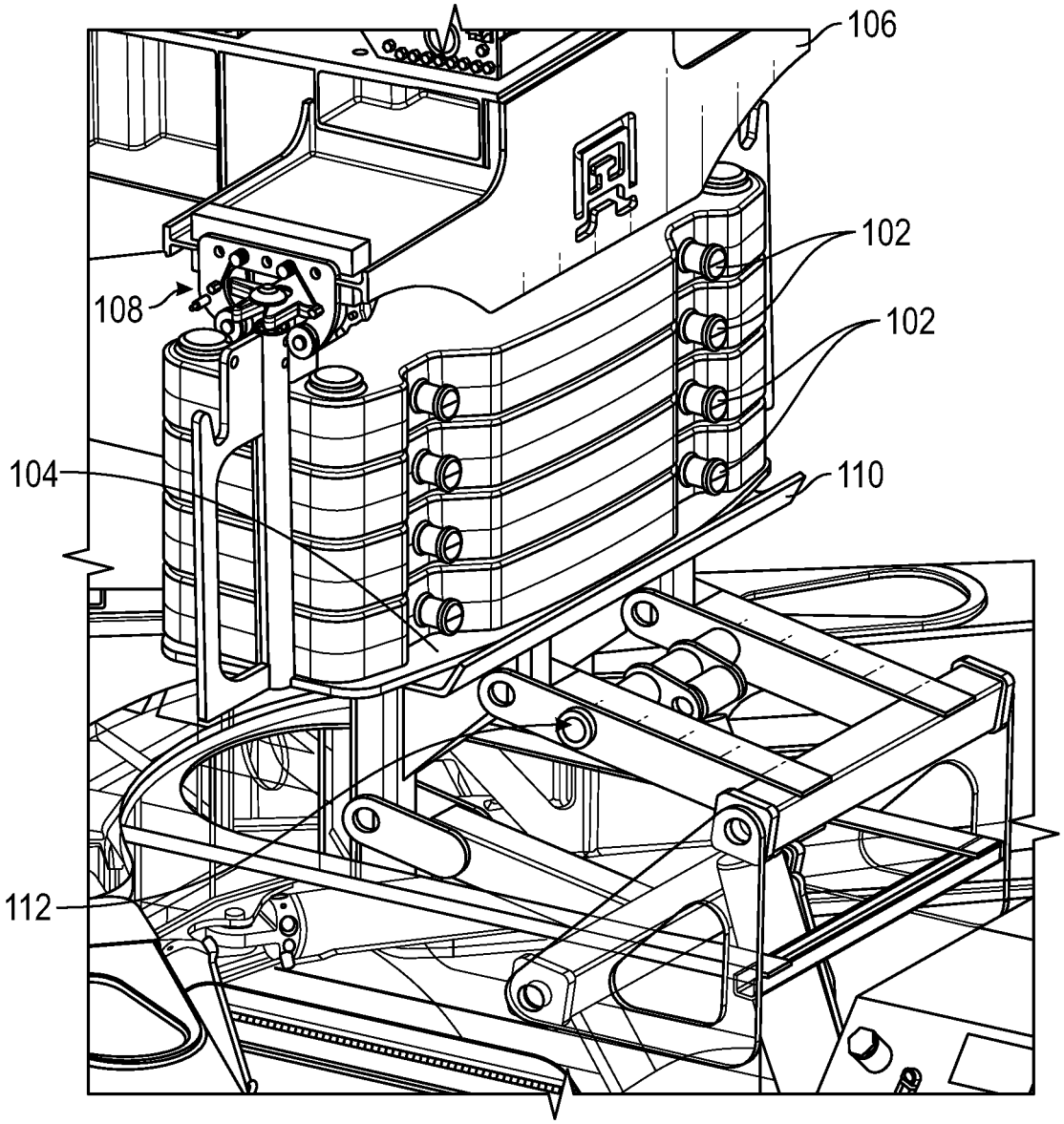
FIG. 3B is a perspective view of a removable counterweight system and attachment mechanism according to an embodiment of the invention in an attached position.

FIGS. 3A and 3B show a removable tray counterweight system 100 of the invention in the detached and attached positions, respectively. The counterweight system 100 may include multiple slabs 102 stacked on top of each other with a tray 104 provided as the base. A sub-base 110 is attached to a lift mechanism 112 for raising and lowering the counterweight system 100, as can be seen in FIG. 3B.

In one embodiment, the counterweight system 100 may include four slabs weighing about 1,500 lbs. each, two side packs weighing about 3,500 lbs. each, and a tray weighing about 500 lbs. In other embodiments, the counterweight system 100 may weigh from about 4,000 lbs. total to about 6,000 lbs. total or more. Although these are exemplary weights, the design of the invention can accommodate a counterweight system with greater or lesser weights.

In an embodiment, the counterweight system 100 may be attached to turntable 106 by an attachment mechanism 108. Attachment mechanism 108 includes lower assembly 200, upper assembly 300, and latch block assembly 400. In some embodiments, the attachment mechanism 108 includes lower assembly 200, upper assembly 300, and latch block assembly 400 located on each of the left side 201 and right side 203 of the slabs 102. In some embodiments, the attachment mechanism on the right side 203 is a mirror version of the attachment mechanism 108 provided on left side 201, as described herein.

Figure 4:
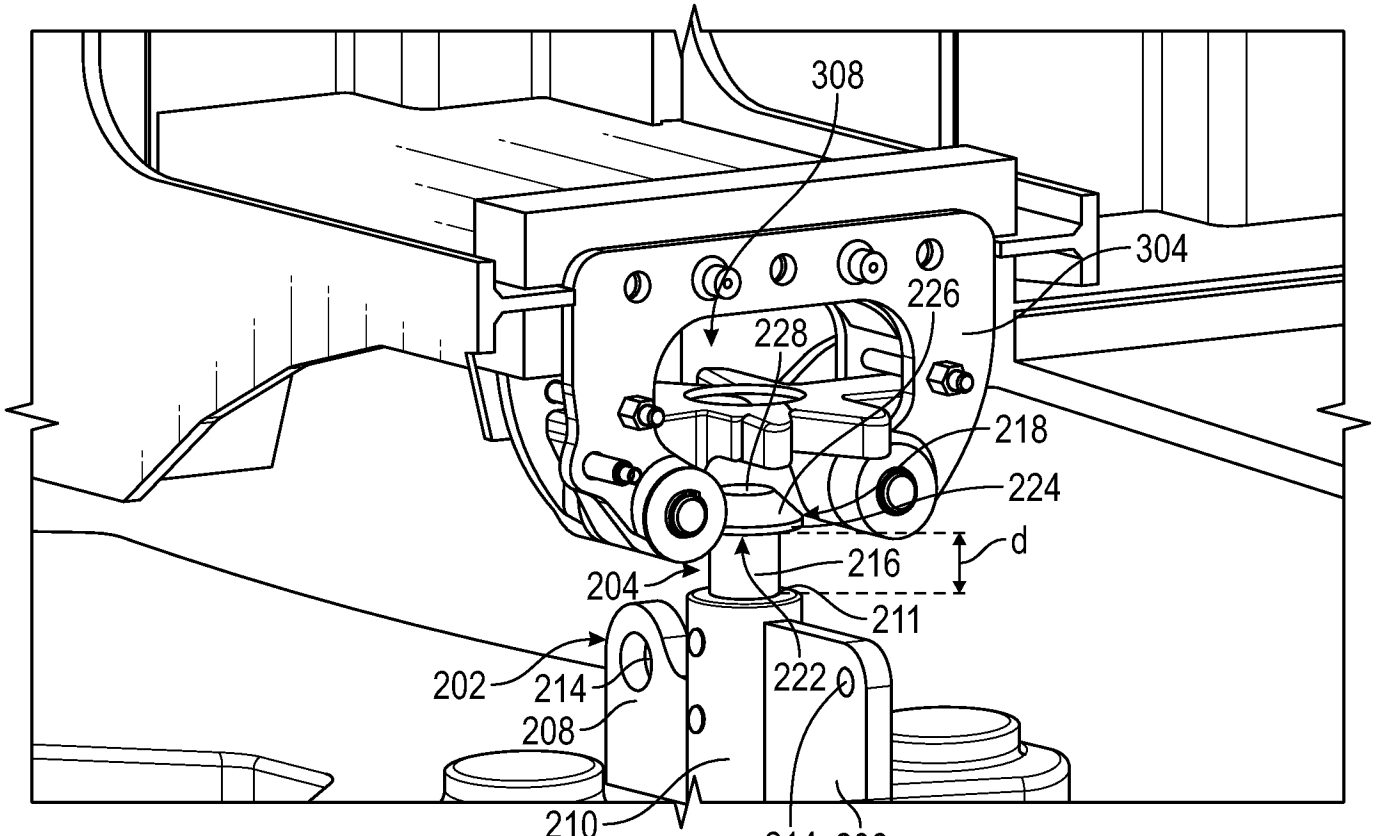
FIG. 4 is a perspective view of an attachment mechanism according to an embodiment of the invention, including a lower assembly, an upper assembly, and a latch block assembly.

With reference to FIGS. 3A, 3B, and 4, lower assembly 200 includes a plate assembly 202 and stud 204. Plate assembly 202 is attached to the tray 104 at the proximal end 205 and receives stud 204 at the distal end 207. Plate assembly 202 includes an outer side plate extension 206, an inner side plate extension 208, and a central cylinder 210. In some embodiments, the outer side plate extension 206, the inner side plate extension 208, and the central cylinder 210 form a unitary structure. Cylinder 210 has a proximal end 209 and a distal end 211 and a central bore 212 therethrough. Stud 204 is received within central bore 212 of cylinder 210.

Outer side plate extension 206 and inner side plate extension 208 may additionally include openings 214 for attachment mechanisms. In one embodiment, opening 214 on the distal end 207 of outer side plate extension 206 can be used to connect attachments, such as side packs, to the counterweight system.

With reference to FIG. 4, stud 204 includes a shaft 216 and a head 218. The majority of shaft 216 is mounted within central bore 212 of cylinder 210. An upper portion 220 of shaft 216 extends a predetermined distance d above distal end 211 of cylinder 210. In some embodiments, the predetermined distance d is about 1.75 in. In some embodiments, the distance d may be about 1 in. to about 2.5 in. Head 218 of stud 204 includes a lower flat surface 222, a side circumferential surface 224, an upper slanted surface 226, and a flat tip 228. In some embodiments, stud 204 may be movably mounted in bore 212. If the tray 104 is misaligned when lowered into engagement with the latch block assembly 400, the portion of the block 402, 404 that is furthest out of alignment will contact the stud 204 first and cam the stud 204 over into alignment. In some embodiments, stud 204 may be fixedly attached to cylinder 210. In some embodiments, stud 204 may be pinned into bore 212 so it could be easily replaced if damaged without having to replace the entire lower assembly 200.

Figure 5:
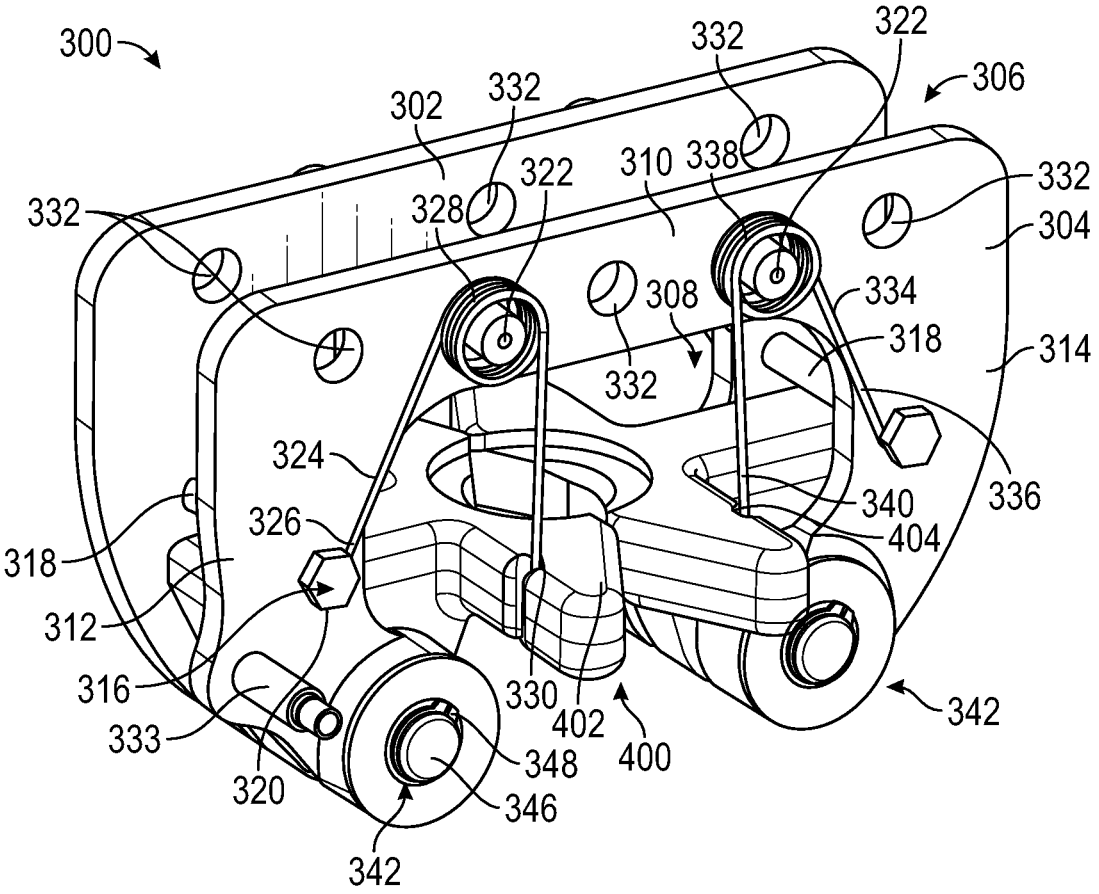
FIG. 5 is a perspective view of the upper assembly and the latch block assembly according to an embodiment of the invention.

With reference to FIG. 5, upper assembly 300 forms a frame including a spaced apart inner plate 302 and outer plate 304 having a gap 306 therebetween. In some embodiments the gap may measure from about 0.1 in. to 0.5 in. In some embodiments, the gap may measure about 0.25 in. In some embodiments, plates 302, 304 may be substantially C-shaped with a central opening 308. In some embodiments, central opening 308 may have curved sides, which may form an open-ended oval. Plates 302, 304 are mounted to turntable 106 such that the C-shape is turned on its side, as shown in FIG. 4. The C-shape of each of plates 302, 304 has a top flat portion 310, a left side 312 extending downwardly, and a right side 314 extending downwardly, to create central opening 308. As seen in FIG. 5, left side 312 may have an outer edge that is substantially straight. In other embodiments, left side 312 may have an outer edge that is curved. As seen in FIG. 5, right side 314 may have an outer edge that is curved. In other embodiments, right side 314 may have an outer edge that is substantially straight.

Latch block assembly 400 may be mounted within the central opening 308 in the gap 306 between plates 302, 304. In some embodiments, latch block assembly 400 can include a first block 402 and a second block 404, as will be described further herein with respect to FIGS. 6A, 6B, and 6C.

Plates 302 and 304 can be fixedly or removably attached together by multiple connection mechanisms, as shown in FIG. 5. In one embodiment, a first attachment mechanism 316 may be bolts, pins, screws, rivets, or any other mechanical attachment means. In one embodiment, first attachment mechanism 316 may be located on both the left side 312 and right side 314 of the plates 302, 304. In one embodiment, first attachment mechanism 316 is a bolt having a shaft 318 extending through gap 306 and a unitary head 320 attached to the outer end. Alternatively, first attachment mechanism 316 may a nut attached on one or both ends of shaft 318 by mechanical threading, as shown in FIGS. 8A, 8B, and 8C.

Outer plate 304 may include at least one post 322 extending outwardly from top flat portion 310 above central opening 308. A first spring 324 may have a distal end 326 connected to first attachment mechanism 316, a central coiled portion 328 received around post 322, and a proximal end 330 connected to latch block assembly 400. In one embodiment, outer plate 304 includes two posts 322 as shown in FIG. 5, such that a first spring 324 may be provided on left side 312 and a second spring 334 may be provided on right side 314, as will be described further below.

Second spring 334 may have a distal end 336 connected to a first attachment mechanism 316, a central coiled portion 338 received around post 322, and a proximal end 340 connected to latch block assembly 400. First spring 324 and second spring 334 may be used to facilitate opening and closing of the latch block assembly 400.

Although described herein with respect to outer plate 304, in some embodiments, inner plate 302 may have a similar post and spring configuration for facilitating the opening/closing of the inner wing portions 410, 420 of blocks 402, 404, respectively.

Inner plate 302 and outer plate 304 may include additional openings 332 for receiving additional attachment mechanisms. In some embodiments, the additional openings 332 in inner plate 302 and outer plate 304 are aligned such that additional attachment mechanisms can be provided therethrough to connect the plates 302, 304 together.

Figure 7:
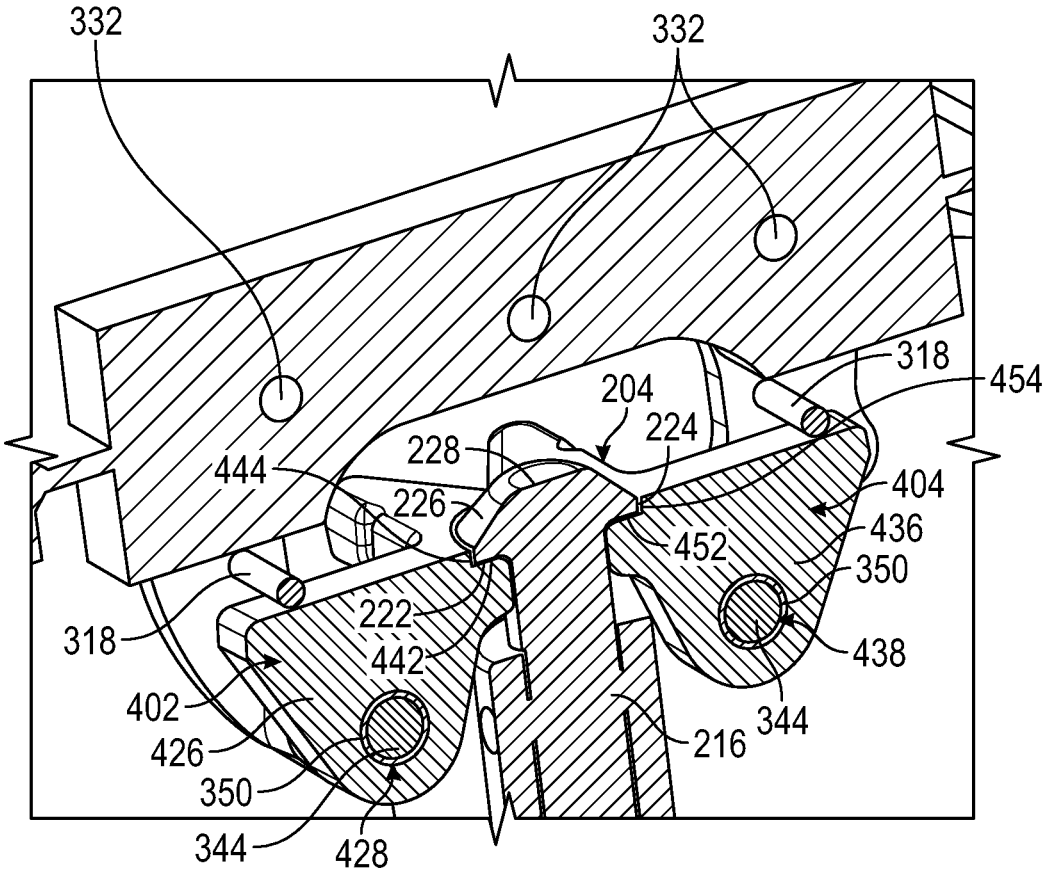
FIG. 7 is a cross-sectional view of the attachment mechanism according to an embodiment of the invention.

The lower end of both the left side 312 and the right side 314 can include a second attachment mechanism 342 for connecting the latch block assembly 400 to the plates 302, 304. The second attachment mechanism 342 forms an axle 344 that allows for rotation of the first and second blocks 402, 404 thereabout, as shown in FIG. 7. The outer end of the axle 344 has a head 346 that may have a retaining ring 348 therearound to prevent the axle 344 from translating longitudinally. The axle 344 can be received through each of bores 428, 438 in first and second blocks 402, 404, respectively, as will described further herein with respect to FIG. 7. Bores 428, 438 may additionally include a plain bearing 350 therein for reducing the friction during rotation of first and second blocks 402, 404, as shown in FIG. 7. Plain bearing 350 may be cylindrical or semi-cylindrical.

Figure 6A:
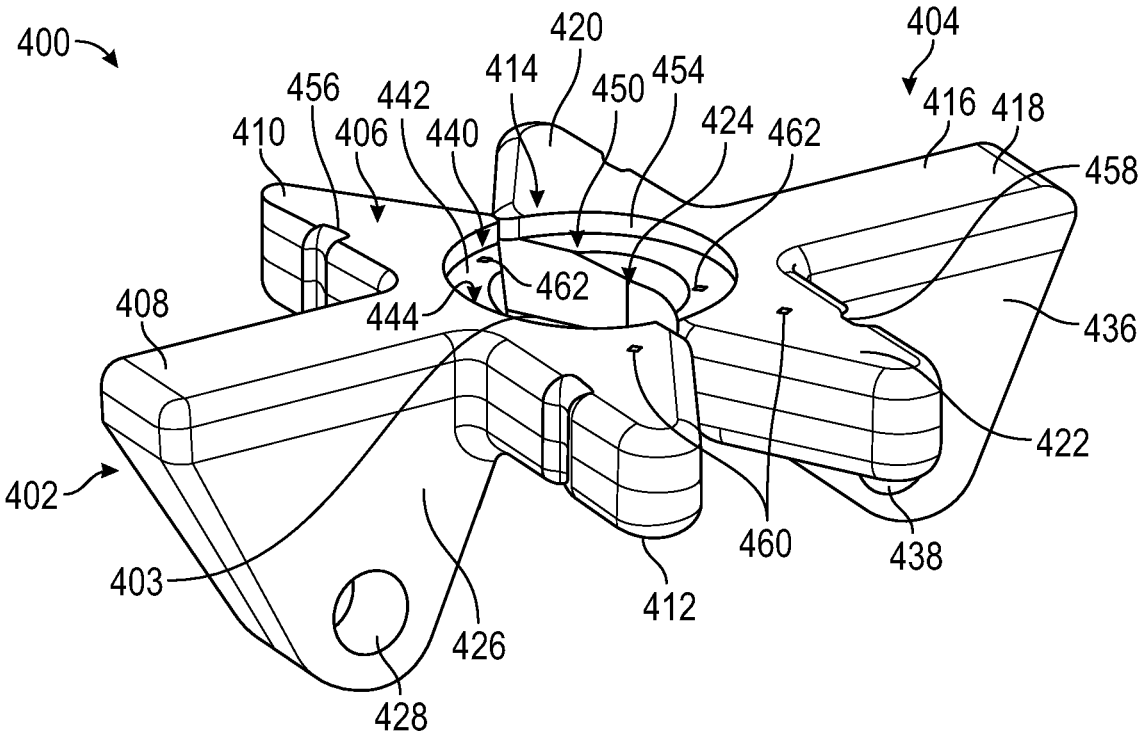
FIG. 6A is a perspective view of the latch block assembly according to an embodiment of the invention.

With respect to FIG. 6A, latch block assembly 400 includes first block 402 and second block 404, which cooperate together to form a central counterbore 403 for receiving stud 204 therein. First block 402 has a first top surface 406 that is substantially T-shaped having a first stem portion 408, a first inner wing portion 410, and a first outer wing portion 412. A first substantially semicircular opening 414 is located at the intersection of the first inner wing portion 410 and the first outer wing portion 412.

Similar to first block 402, second block 404 has a second top surface 416 that is substantially T-shaped having a second stem portion 418, a second inner wing portion 420, and a second outer wing portion 422. A second substantially semicircular opening 424 is located at the intersection of the second inner wing portion 420 and the second outer wing portion 422.

The first inner wing portion 410, the first outer wing portion 412, the second inner wing portion 420, and the second outer wing portion 422 are all substantially triangularly shaped such that when the first block 402 and the second block 404 are mounted adjacent to each other between plates 302, 304, they form a substantially star-shaped configuration, as seen in FIG. 6A. In other embodiments, the latch block assembly 400 may be composed of four rotatable blocks rather than two blocks 402, 404.

First stem portion 408 extends down from the first top surface 406 forming a connection portion 426 for connecting the first block 402 to the plates 302, 304. First connection portion 426 has a substantially triangular-shaped cross-section, as shown in FIG. 7. First connection portion 426 includes a first bore 428 for receiving axle 344 and optional plain bearing 350 therein.

Second stem portion 418 extends down from the second top surface 416 forming a second connection portion 436 for connecting the second block 404 to the plates 302, 304. Second connection portion 436 has a substantially triangular-shaped cross-section, as shown in FIG. 7. Second connection portion 436 includes a second bore 438 for receiving axle 344 and optional plain bearing 350 therein.

The operation of attachment mechanism 108 will now be discussed with respect to FIGS. 8A, 8B and 8C. In operation, the counterweight system 100 may be mounted to the turntable 106 by attachment mechanism 108. Specifically, lower assembly 200 is connected to upper assembly 300 by engagement of stud 204 with latch block assembly 400.

As shown in FIG. 8A, the stud 204 may first be aligned below the latch block assembly 400. The lower assembly 200 can then be raised such that head 218 of stud 204 pushes up on blocks 402, 404. The force causes blocks 402, 404 to rotate on axles 344 to an open position. Once the head 218 has cleared the counterbore 403 of blocks 402, 404, then springs 324, 334 and gravity cause blocks 402, 404 to rotate downwardly back to their closed resting position, as seen in FIGS. 8B and 9. Then lower assembly 200 can then be lowered such that head 218 of stud 204 is seated within central counterbore 403, as seen in FIGS. 7 and 8C.

Alternatively, the turntable 106 may be rotated laterally to engage the stud 204 with the latch block assembly 400. Stud 204 can be received from either direction, entering the latch block assembly 400 from either the inner side between the first inner wing portion 410 and the second inner wing portion 420, or from the outer side between the first outer wing portion 412 and second outer wing portion 422.

Figure 6B:
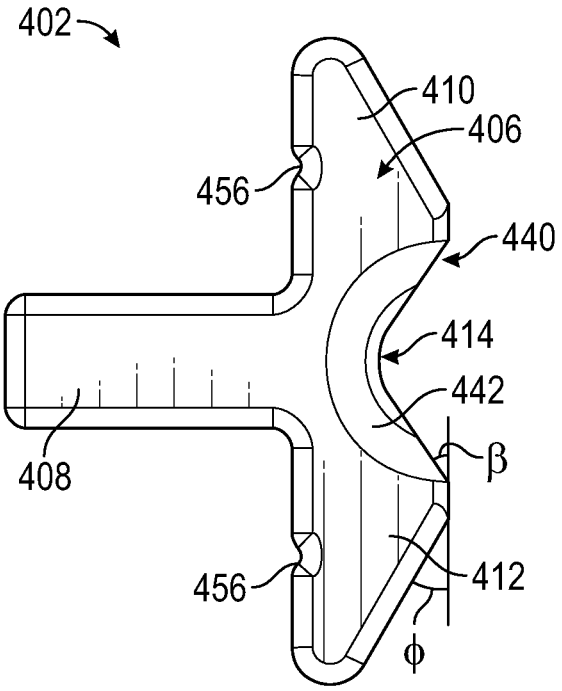
FIGS. 6B and 6C are top plan views of each block of the latch block assembly according to an embodiment of the invention.

A difference in the lead-in angles on the inside and outside of the blocks 402, 404 make it easier to swing the stud 204 into engagement with the blocks 402, 404 than to remove the stud 204 therefrom. As shown in FIG. 6B, the lead-in angle $\theta$ may be about 30 degrees and the lead-out angle $\beta$ may be about 35 degrees. In some embodiments, the lead-in angle may range from 20-40 degrees and the lead-out angle may range from 25-45 degrees. The operator can thereby feel when the stud 204 has entered the opening between the blocks 402, 404. In some embodiments, the surfaces may be curved to allow for easier insertion of the stud.

Central counterbore 403 is formed by first semicircular opening 414 and second semicircular opening 424. First semicircular opening 414 and second semicircular opening 424 cooperate together to receive head 218 of stud 204. In some embodiments, first semicircular opening 414 includes a recessed portion 440 forming a lip 442 and an inner circumferential rim 444. In some embodiments, second semicircular opening 424 includes a recessed portion 450 forming a lip 452 and an inner circumferential rim 454. In an engaged position, lower flat surface 222 of head 218 will rest on lips 442, 452 and side circumferential surface 224 of head 218 will contact inner circumferential rims 444, 454, as shown in FIG. 7.

Figure 6C:
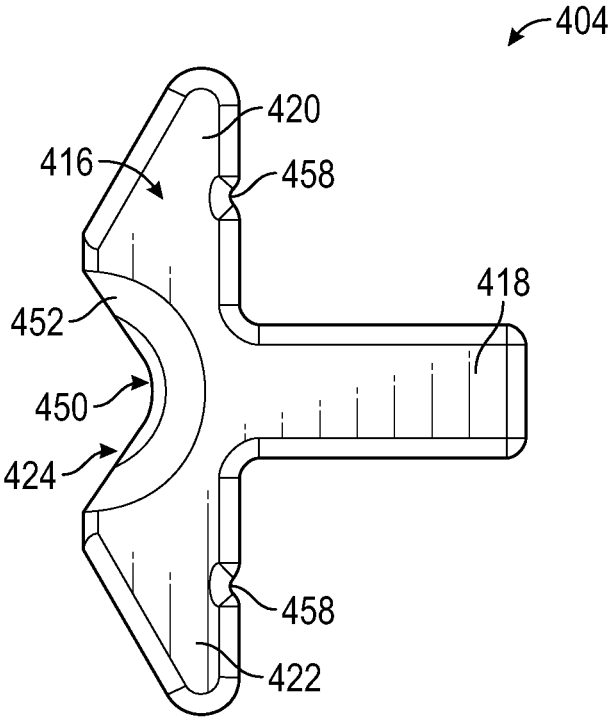

A proximal end 330 of first spring 324 is fixedly connected to block 402 at first outer wing portion 412, as shown in FIG. 5. A side surface of first outer wing portion 412 includes a channel 456 for receiving the first spring 324 therein, as shown in FIG. 6B. Similarly, a proximal end 340 of second spring 334 is fixedly connected to block 404 at second outer wing portion 422. A side surface of second outer wing portion 422 includes a channel 458 for receiving the second spring 334 therein, as shown in FIG. 6C. Springs 324, 334 cooperate together to return blocks 402, 404 to a closed resting position where the top surfaces 406, 416 are substantially perpendicular to the inner planar surfaces of plates 302, 304. Additional similar springs can be provided on posts extending from inner plate 302. Similarly, a side surface of first inner wing portion 410 includes a channel 456 and a side surface of second inner wing portion 420 includes a channel 458 for receiving an end of a spring therein, as shown in FIGS. 6B and 6C.

When the stud 204 is in the engaged position, the latch block assembly 400 cannot be opened by lateral motion of either the turntable 106 or of the counterweight system 100. Rather, in order to remove the counterweight system 100 from the turntable 106, the lower assembly 200 is raised to such that head 218 of stud 204 is lifted out of recessed portions 440, 450, as shown in FIG. 8B. The distal end 211 of cylinder 210 pushes up on blocks 402, 404, thereby causing blocks 402, 404 to rotate on axles 344 to an open position, as shown in FIG. 8A. The turntable 106 can then be moved laterally in either direction such that the lower assembly 200 is released therefrom. Once the head 218 has cleared the counterbore 403 of blocks 402, 404, springs 324, 334 cause blocks 402, 404 to rotate downwardly back to their closed resting position, as shown in FIG. 4.

Latch block assembly 400 may include proximity sensors 460 and/or contact sensors 462, or other desired sensors for assisting the operator in remotely determining the position of the elements of the device. Proximity sensors 460 may detect when the latches are in the resting position. In some embodiments, proximity sensors may be located on one or both of blocks 402, 404. In some embodiments, outer plate 304 may also include a proximity sensor 333 for detecting when the blocks 402, 404 are in a closed position. Contact sensors 462 may detect when the stud 204 is seated in the engaged position. In some embodiments, contact sensors 462 may be located within the counterbore 403, and may be located on one or both of recessed portion 440, 450. Counterweight system 100 may further include audible and/or visual alarms associated with the sensors 460, 462. For example, an audible or visual alarm may be triggered when an operator attempts to move the turntable 106 when the blocks 402, 404 are in an open position. Additionally, the sensors 333, 460, 462 may be associated with preventing a swing command for the turntable 106 in certain instances.

Although illustrated herein with a tray counterweight system, in some embodiments, the counterweight attachment mechanism can be used with a pinned slab counterweight system. Although the latch block assembly is illustrated herein as mounted to the turntable, in some embodiments, the latch block assembly could be mounted to the tray or mounted to counterweight lift cylinders. Additionally, the lift mechanism is illustrated herein mounted to a sub-base, however in some embodiments the lift mechanism could be mounted to the crane turntable.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

The invention claimed is:

1. An attachment mechanism for connecting a removable counterweight system to a crane, said attachment mechanism comprising:

a lower assembly adapted to be connected to the counterweight system, an upper assembly adapted to be mounted to the crane, and a latch block assembly mounted to the upper assembly, said lower assembly comprising a stud;

said upper assembly comprising:

a frame formed by an inner plate and an outer plate attached together having a gap therebetween; and said latch block assembly comprising:

a plurality of blocks cooperating together to form a central counterbore for receiving the stud therein, said plurality of blocks mounted within the frame by at least one axle extending through a bore of at least one block of the plurality of blocks to allow for rotation of the at least one block, wherein a distal end of the stud is removably connected to the latch block assembly to attach the counterweight system to the crane.

2. The attachment mechanism of claim 1, wherein the plurality of blocks comprises at least a first block and a second block, and the at least one axle comprises a first axle extending through a bore of the first block to allow the first block to rotate thereabout, and a second axle extending through a bore of the second block to allow the second block to rotate thereabout.

3. The attachment mechanism of claim 2, wherein each of the first block and the second block comprise:

a stem portion, a first wing portion, a second wing portion, and a substantially semicircular opening.

4. The attachment mechanism of claim 1, further comprising at least one spring attached to the at least one block and the frame.

5. The attachment mechanism of claim 4, wherein the at least one spring includes a first spring attached to the inner plate and a second spring attached to the outer plate.

6. The attachment mechanism of claim 5, wherein the first spring and the second spring are both attached to a first block of the plurality of blocks.

7. The attachment mechanism of claim 6, wherein the at least one spring further includes a third spring attached to the inner plate and a fourth spring attached to the outer plate, wherein the third spring and the fourth spring are both attached to a second block of the plurality of blocks.

8. The attachment mechanism of claim 1, wherein the central counterbore comprises a recessed portion forming a lip and an inner circumferential rim, wherein a head of the stud is configured to engage the recessed portion.

9. The attachment mechanism of claim 1, wherein the lower assembly further comprises a plate assembly and a cylinder, wherein the stud is received within the cylinder.

10. A system for connecting a removable counterweight system to a crane, said system comprising:

a crane comprising a boom assembly having a proximal end and a distal end;

a turntable attached to the proximal end of the boom assembly; and an attachment mechanism for connecting the removable counterweight system to the turntable;

said attachment mechanism comprising:

a lower assembly adapted to be connected to the counterweight system, an upper assembly mounted to the turntable, and a latch block assembly mounted to the upper assembly, said lower assembly comprising a stud;

said upper assembly comprising:

a frame formed by an inner plate and an outer plate attached together having a gap therebetween; and said latch block assembly comprising:

a plurality of blocks cooperating together to form a central counterbore for receiving the stud therein, said plurality of blocks mounted within the frame by at least one axle extending through a bore of at least one block of the plurality of blocks to allow for rotation of the at least one block, wherein a distal end of the stud is removably connected to the latch block assembly to attach the counterweight system to the crane.

11. The system of claim 10, wherein the plurality of blocks comprises at least a first block and a second block, and the at least one axle comprises a first axle extending through a bore of the first block to allow the first block to rotate thereabout, and a second axle extending through a bore of the second block to allow the second block to rotate thereabout.

12. The system of claim 11, wherein each of the first block and the second block comprise:

a stem portion, a first wing portion, a second wing portion, and a substantially semicircular opening.

13. The system of claim 10, further comprising at least one spring attached to the at least one block and the frame.

14. The system of claim 10, wherein the central counterbore comprises a recessed portion forming a lip and an inner circumferential rim, wherein a head of the stud is configured to engage the recessed portion.

15. A method of connecting a removable counterweight system to a crane with an attachment mechanism, said attachment mechanism comprising:

a lower assembly adapted to be connected to the counterweight system, an upper assembly adapted to be mounted to the crane, and a latch block assembly mounted to the upper assembly, said lower assembly comprising:

a plate assembly including a cylinder; and a stud having a shaft mounted within the cylinder and a head extending from a distal end of the cylinder, said upper assembly comprising:

a frame formed by an inner plate and an outer plate attached together having a gap therebetween; and said latch block assembly comprising:

a plurality of blocks cooperating together to form a central counterbore for receiving the stud therein, said plurality of blocks mounted within the frame by at least one axle extending through a bore of at least one block of the plurality of blocks to allow for rotation of the at least one block, said method comprising:

raising the lower assembly such that the head of the stud pushes up on at least one block of the plurality of blocks to cause the at least one block to rotate from a closed position to an open position; and then lowering the lower assembly such that the head of the stud rests in the central counterbore thereby attaching the counterweight system to the crane.

16. The method of claim 15, further comprising:

raising the lower assembly such that the head of the stud is lifted out of the central counterbore and the plate assembly pushes up on the at least one block to cause the at least one block to rotate to the open position.

17. The method of claim 16, further comprising:

laterally moving the upper assembly to release the stud therefrom and remove the counterweight.

18. The method of claim 15, further comprising:

before lowering the lower assembly, rotating the at least one block to the closed position using at least one spring.

19. The method of claim 15, wherein in the closed position, a top surface of the at least one block is substantially perpendicular to a planar surface of the inner plate or the outer plate.

20. The method of claim 15, wherein in the open position, a top surface of the at least one block is inclined relative to a planar surface of the inner plate or the outer plate.

* * * * *